US009249804B2

(12) United States Patent
Nagahara et al.

(10) Patent No.: US 9,249,804 B2
(45) Date of Patent: Feb. 2, 2016

(54) BARREL-TYPE MULTISTAGE PUMP

(75) Inventors: Takahide Nagahara, Abiko (JP); Daichi Torii, Tsukuba (JP); Tetsuya Yoshida, Tsuchiura (JP)

(73) Assignee: Hitachi, Ltd., Tokyo (JP)

( * ) Notice: Subject to any disclaimer, the term of this patent is extended or adjusted under 35 U.S.C. 154(b) by 820 days.

(21) Appl. No.: 13/343,006

(22) Filed: Jan. 4, 2012

(65) Prior Publication Data

US 2012/0171014 A1 Jul. 5, 2012

(30) Foreign Application Priority Data

Jan. 5, 2011 (JP) ..... 2011-000462

(51) Int. Cl.

| | |
|---|---|
| ***F04D 1/06*** | (2006.01) |
| ***F04D 17/12*** | (2006.01) |
| ***F04D 29/44*** | (2006.01) |
| ***F04D 29/42*** | (2006.01) |

(52) U.S. Cl.

CPC ..... *F04D 17/125* (2013.01); *F04D 1/063* (2013.01); *F04D 29/4206* (2013.01); *F04D 29/426* (2013.01); *F04D 29/441* (2013.01); *F04D 29/445* (2013.01)

(58) Field of Classification Search

CPC ..... F04D 1/063; F04D 17/125; F04D 29/441; F04D 29/426; F04D 29/445; F04D 29/4206

USPC ..... 415/199.1, 199.2, 199.3, 224.5

See application file for complete search history.

(56) References Cited

U.S. PATENT DOCUMENTS

| | | | | | |
|---|---|---|---|---|---|
| 3,103,892 | A | * | 9/1963 | McFarland | 415/185 |
| 3,105,632 | A | * | 10/1963 | Tanzberger | 417/323 |
| 3,118,386 | A | * | 1/1964 | Carswell | 137/412 |
| 3,153,383 | A | * | 10/1964 | Pilarczyk | 415/199.2 |
| 3,788,764 | A | | 1/1974 | Wilk et al. | |
| 4,493,611 | A | | 1/1985 | Funakoshi et al. | |
| 4,715,778 | A | * | 12/1987 | Katayama et al. | 415/104 |

(Continued)

FOREIGN PATENT DOCUMENTS

| | | | | | |
|---|---|---|---|---|---|
| JP | 58144689 | A | * | 8/1983 | F04D 1/08 |
| JP | 60098194 | A | * | 6/1985 | F04D 1/06 |

(Continued)

OTHER PUBLICATIONS

JP Office Action of Appln. No. 2011-000462 dated Feb. 25, 2014 with English translation.

(Continued)

*Primary Examiner* — Ninh H Nguyen
*Assistant Examiner* — Christopher R Legendre
(74) *Attorney, Agent, or Firm* — Mattingly & Malur, PC

(57) ABSTRACT

A barrel-type multistage pump with uniformed velocity distribution in an axial direction, on a cross-section of a rotating flow channel, to suppress fluid loss in a last stage, and including: plural stages of centrifugal impellers, covered by an inner casing; diffusers and return channels provided on downstream sides of said centrifugal impellers, to guide the flow of a fluid to a centrifugal impeller in the next stage, and return vanes arranged at respective return channels; a cylindrical outer casing having a suction pipe and a discharge pipe, wherein a cylindrical rotating flow channel connected to a discharge opening is provided between an outer casing and an inner casing, a connecting channel to connect between a rotating flow channel and diffusers.

10 Claims, 9 Drawing Sheets

(56) References Cited

U.S. PATENT DOCUMENTS

| | | | | |
|---|---|---|---|---|
| 5,522,701 | A | 6/1996 | Nicklas et al. | |
| 6,568,904 | B1 * | 5/2003 | Ueyama et al. | 415/199.2 |
| 7,882,632 | B2 * | 2/2011 | Yoshida et al. | 29/888.024 |
| 2012/0171014 | A1 * | 7/2012 | Nagahara et al. | 415/100 |
| 2014/0366533 | A1 * | 12/2014 | Shioda | 60/605.2 |

FOREIGN PATENT DOCUMENTS

| | | |
|---|---|---|
| JP | 64-15498 | 1/1989 |
| JP | 07-54798 | 2/1995 |
| JP | 11-303796 | 11/1999 |
| JP | 2006-152849 | 6/2006 |
| JP | 2009156097 | 7/2009 |

OTHER PUBLICATIONS

Extended European Search Report dated Dec. 9, 2014 for corresponding European Patent Application No. 11 19 5933.

* cited by examiner

Background

Background

Background

Background

BARREL-TYPE MULTISTAGE PUMP

BACKGROUND OF THE INVENTION

The present invention relates to a barrel-type multistage pump used in relatively high-lift applications.

A general structure of diffusers and stages of a conventional barrel-type multistage pump is shown in FIG. 1. In the centrifugal multistage pump, the kinetic energy of a fluid flowing out of impellers 1 in the centrifugal direction is converted into a pressure energy at an enlarged flow channel of diffusers 16 with blades provided at outer circumferences of the impellers, the direction of the fluid is turned to the inside in the radial direction at a U-turn passage 17 formed at each stage on the outer circumferential side of the diffusers, and then the fluid is guided to the impeller in the next stage by using return vanes 20 provided on the downstream side of the U-turn passage 17. In the last stage, the fluid discharged from the entire circumferences of the diffusers 16 is fed to a discharge pipe 41 via a connecting channel 19 and a rotating flow channel 18. The meridional plane of the connecting channel 19 is provided in a direction orthogonal to a rotary shaft 10, namely, the meridional plane of the connecting channel 19 is linearly provided in the outer circumferential direction, a junction part between the connecting channel 19 and the rotating flow channel 18 is provided at a position apart from a center line 41 a of the discharge pipe 41. The object of providing the junction part at a position apart from the center line 41*a* of the discharge pipe 41 is to shorten the length of the pump in the axial direction by shifting the position of the discharge pipe 41 to the side of a suction opening 3, and to reduce the cost by reducing the size and weight of the pump. However, a fluid loss occurs at a position where the fluid is discharged in the above-described configuration, and there are two possible factors of the fluid loss.

As a first factor, the fluid in the connecting channel 19 flows into the rotating flow channel 18, the most of the fluid flows out after being swirled at an area X near a junction part, and then the fluid flows out to the discharge pipe 41 in the shape of the last stage as shown in FIG. 3. When viewed from the cross-sectional direction of the rotating flow channel 18, the velocity of the rotating flow is high near the junction part X with the connecting channel 19, whereas the velocity thereof is low near a position Y on the suction side of the pump that is apart from the junction part X. Accordingly, the velocity non-uniformity on the cross-section causes a fluid loss. Further, as the flow near this position on the cross-section of the meridional plane, the direction of the fluid flowing out of the connecting channel 19 is once turned to the axial direction of the pump at the rotating flow channel 18 as shown in FIG. 4, and is further turned to the outer circumferential direction again at a position reaching the discharge pipe 41. As a result, the fluid reaches the discharge pipe 41 so as to pass through a crank. In particular, when the fluid flows into the discharge pipe 41, the direction of the flow that is originally fast in the circumferential direction is further turned to a direction orthogonal to the axial direction. Thus, the fluid cannot flow along the shape at this position, and is largely separated and disordered, leading to an enormous fluid loss.

As a second factor, as shown in FIG. 5 that is viewed from the cross-sectional direction passing through the connecting channel 19 and the discharge opening 4 shown in FIG. 4, when the fluid flowing out of the impellers 1 passes through a guide impeller blade 16*a* provided at the diffuser 16 to reach the rotating flow channel 18 via the connecting channel 19, all the flow does not reach the discharge pipe 41 after flowing out in one direction of the rotating flow channel 18 in the rotational direction of the impellers. Near the discharge pipe 41, in particular, it has been found that a part of the fluid flowing out of the connecting channel 19 flows in a direction opposed to the rotational direction (indicated by the arrows) of the impellers 1 under the influence of the disorder of the flow near the discharge pipe 41, and interferes with the fluid flowing in the forward direction of the rotating flow channel before reaching the discharge pipe. An enormous flow loss occurs also at the position.

The second factor is possibly and mainly derived from the fact that the cross-sectional area of the rotating flow channel 18 is constant in the circumferential direction, and the amount of flow flowing into the rotating flow channel 18 from the connecting channel 19 is constant in the circumferential direction. Thus, the velocity of flow in the rotating flow channel 18 in the rotational direction of the impellers is increased in the rotational direction of the impellers 1 from a connecting part between the rotating flow channel 18 and the discharge pipe 41, and then the fluid flows out via the discharge pipe 41. However, near the downstream side of the impellers 1 in the rotational direction from the connecting part between the rotating flow channel and the discharge pipe 41 in the rotating flow channel 18, the velocity of the flow in the circumferential direction is significantly lowered, and the fluid cannot smoothly flow. Thus, the fluid flows in a direction opposed to the swirl direction at this position.

Japanese Patent Application Laid-Open No. H11-303796 proposes a vortex pump or a radial flow pump in which the cross-sectional area of a rotating flow channel is gradually increased in the rotational direction of impellers from a position apart from a discharge opening to the discharge opening, so that the cross-sectional area of the rotating flow channel is gradually increased in the same direction. In addition, Japanese Patent Application Laid-Open No. 2006-152849 proposes a centrifugal pump in which a spiral-shaped groove that is gradually deepened towards a discharge opening is provided, in the rotational direction, from a circular part between an outer circumferential edge of an inner wall surface of a discharge casing and a circular arc corresponding to an outer circumferential circle of impellers. These are provided to contribute to reduction in energy consumption while the flow in the rotating flow channel is rectified and a loss in the flow channels, inside the pump is reduced to improve the efficiency of the pump.

SUMMARY OF THE INVENTION

However, in the vortex pump disclosed in Japanese Patent Application Laid-Open No. H11-303796, the structure in which the cross-sectional area is gradually increased near a position passing the discharge pipe in the swirl direction of the discharge flow channel is provided only near an outlet of the impellers, and the cross-sectional area of the rotating flow channel is not changed near the rear of the discharge pipe in the swirl direction. Thus, the fluid does not smoothly flow and backflow occurs to interfere with the rotating flow. Thus, it is impossible to reduce a fluid loss. Further, in the radial flow pump, the position of the center line of the discharge pipe matches the center of the outlet flow channel of the impellers. Thus, in the case where this structure is applied to a barrel pump, the discharge pipe cannot be mounted unless the length of the barrel is designed to be long because the diameter of the discharge pipe is generally larger than the width of the outlet of the impeller in the last stage. In this case, the size of the pump becomes large and the cost is increased.

In the case where the spiral-shaped groove that is gradually deepened towards the discharge opening in the centrifugal pump disclosed in Japanese Patent Application Laid-Open No. 2006-152849 is applied to a barrel pump, it is apparent that the barrel needs to be designed to be long in the discharge direction. Thus, the size of the pump becomes large as similar to Japanese Patent Application Laid-Open No. H11-303796. Further, it is conceivable that the fluid cannot smoothly flow at an area near the rear of the discharge pipe in the swirl direction. Thus, the fluid flows in a direction opposed to the swirl direction to increase a fluid loss.

In view of the conventional problem, the present invention provides a barrel-type multistage pump in which a discharge position of a rotating flow channel is located near the central axis of a discharge pipe, and velocity distribution in the axial direction on the cross-section of the rotating flow channel is uniformed to suppress a fluid loss in the last stage.

In order to solve the problem, the present invention provides a barrel-type multistage pump including: centrifugal impellers that are provided at a rotary shaft in plural stages; an inner casing that covers the centrifugal impellers, and includes diffusers that are provided on the downstream sides of the respective centrifugal impellers in plural stages, return channels that are provided on the downstream sides of the diffusers to guide the flow of a fluid to the centrifugal impeller in the next stage, and return vanes that are arranged at the respective return channels; and a cylindrical outer casing that has a suction pipe as the inlet and a discharge pipe as the outlet of the fluid, wherein a cylindrical rotating flow channel connected to the discharge opening is provided between the outer casing and the inner casing, a connecting channel is provided between the rotating flow channel and the diffusers to connect therebetween, the shape of the connecting channel is inclined on the suction opening side in the rotary shaft direction, and an outflow position of the connecting channel in the rotating flow channel is located near the central axis of the discharge pipe.

Further, in the barrel-type multistage pump, plural guide blades are provided in the connecting channel.

Further, in the barrel-type multistage pump, the radius length of the outer circumference of the rotating flow channel is changed in the circumferential direction, and the cross-sectional area of the rotating flow channel is gradually increased from one end of an inner cylinder of the discharge pipe along the rotational direction of the rotary shaft.

Further, in the barrel-type multistage pump, a protrusion portion protruding towards the inside of the discharge pipe or the rotating flow channel is provided near the one end of the inner cylinder of the discharge pipe.

Further, in the barrel-type multistage pump, inclined angles relative to the center lines of the connecting channel and the discharge pipe are distributed in the circumferential direction.

Further, in the barrel-type multistage pump, plural guide blades are provided in the connecting channel.

Further, in the barrel-type multistage pump, the radius length of the outer circumference of the rotating flow channel is changed in the circumferential direction, and the cross-sectional area of the rotating flow channel is gradually increased from one end of an inner cylinder of the discharge pipe along the rotational direction of the rotary shaft.

Further, in the barrel-type multistage pump, a protrusion portion protruding towards the inside of the discharge pipe or the rotating flow channel is provided near the one end of the inner cylinder of the discharge pipe.

In order to solve the problem, the present invention provides a barrel-type multistage pump including: centrifugal impellers that are provided at a rotary shaft in plural stages; an inner casing that covers the centrifugal impellers, and includes diffusers that are provided on the downstream sides of the respective centrifugal impellers in plural stages, return channels that are provided on the downstream sides of the diffusers to guide the flow of a fluid to the centrifugal impeller in the next stage, and return vanes that are arranged at the respective return channels; and a cylindrical outer casing that has a suction opening and a discharge opening for the fluid, wherein a cylindrical rotating flow channel connected to the discharge opening is provided between the outer casing and the inner casing, a connecting channel is provided between the rotating flow channel and the diffusers to connect therebetween, and a protrusion portion protruding towards the inside of the discharge pipe or the rotating flow channel is provided near one end of an inner cylinder of the discharge pipe.

Further, in the barrel-type multistage pump, the radius length of the outer circumference of the rotating flow channel is changed in the circumferential direction, and the cross-sectional area of the rotating flow channel is gradually increased from one end of an inner cylinder of the discharge pipe along the rotational direction of the rotary shaft.

According to the present invention, energy consumption can be suppressed and the pump can be downsized by suppressing a fluid loss in the last stage of the barrel-type multistage pump and by improving the efficiency of the pump. Thus, the cost and energy related to materials and processes can be reduced, and environmental burdens can be largely suppressed.

According to a first aspect of the present invention, velocity distribution in the axial direction on the cross-section orthogonal to the main axis of the rotating flow channel is uniformed, and thus a pressure loss of a liquid in the rotating flow channel can be reduced.

According to a second aspect of the present invention, the shape of the discharge flow channel realizes control effects of the deceleration rate and rectifying effects of a fluid in the connecting channel, and a loss in the flow channels including the rotating flow channel can be minimized.

According to a third aspect of the present invention, the shape of the discharge flow channel realizes uniformity of velocity distribution of a fluid in the circumferential direction on the cross-section orthogonal to the main axis of the rotating flow channel, and thus a fluid loss can be reduced.

According to a fourth aspect of the present invention, the shape of the discharge flow channel minimizes the disorder of the swirl and flow of a fluid in the rotating flow channel and a discharge nozzle, and thus a pressure loss can be reduced. In addition, velocity distribution in the axial direction on the cross-section orthogonal to the main axis of the rotating flow channel can be uniformed.

According to a fifth aspect of the present invention, distribution in the axial direction of velocities in the circumferential direction of the rotating flow channel is further uniformed, and thus a pressure loss of a liquid in the rotating flow channel can be reduced.

According to a ninth aspect of the present invention, the disorder of the swirl and flow of a fluid in the rotating flow channel and a discharge nozzle is minimized, and thus a pressure loss can be reduced.

DETAILED DESCRIPTION OF PREFERRED EMBODIMENTS (First Embodiment)

Figure 1:
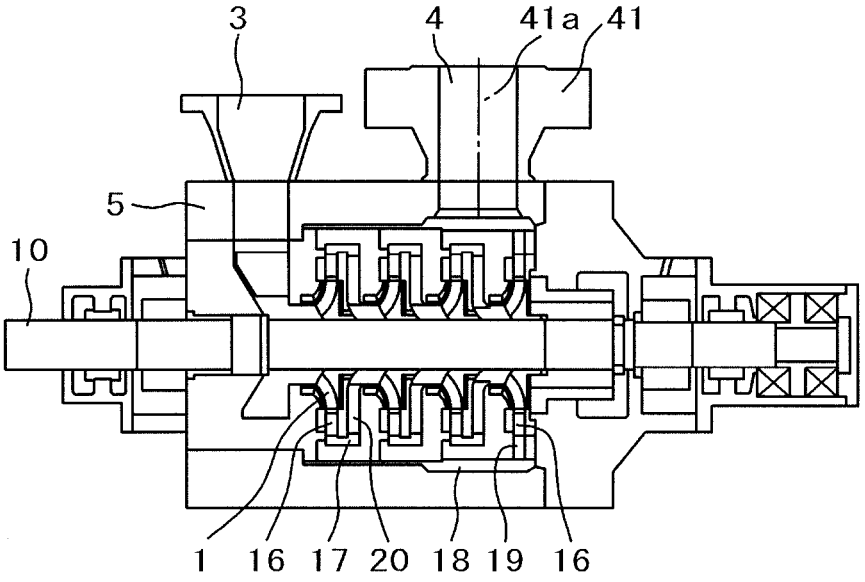
FIG. 1 is a structural view of a conventional barrel-type multistage pump.
Figure 2:
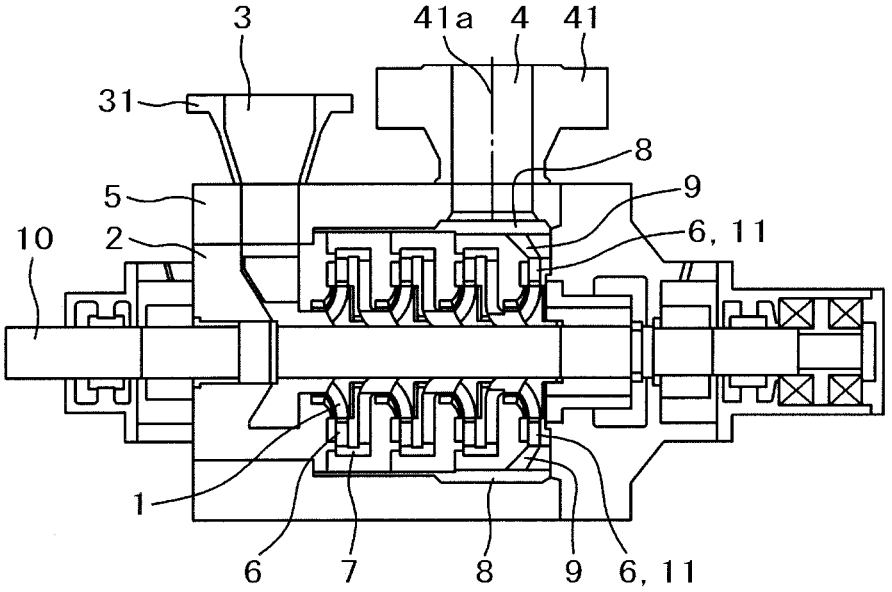
FIG. 2 is a structural view of a first embodiment of the present invention.
Figure 3:
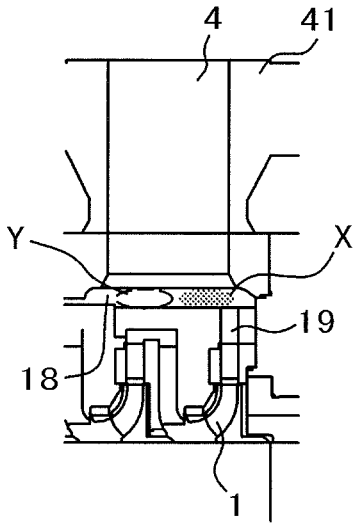
FIG. 3 is a pattern view for showing a problem in a conventional technique.
Figure 4:
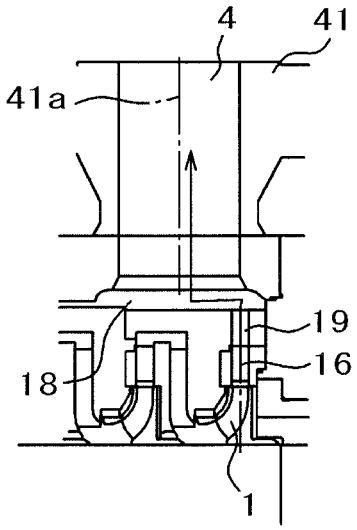
FIG. 4 is a pattern view for showing a problem in a conventional technique.
Figure 5:
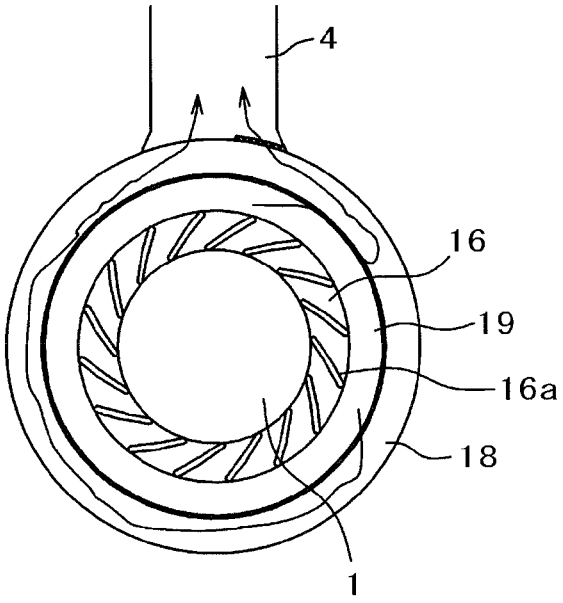
FIG. 5 is a pattern view for showing a problem in a conventional technique.

A first embodiment of the present invention is shown in FIG. 2. A barrel-type multistage pump according to the first embodiment includes centrifugal impellers 1 that are provided at a rotary shaft 10 in plural stages, an inner casing 2 that covers the centrifugal impellers 1, and a cylindrical outer casing 5 having a suction pipe 31 as the inlet and a discharge pipe 41 as the outlet of the fluid. The inner casing 2 includes diffusers 6 that are provided on the downstream sides of the respective centrifugal impellers 1 in plural stages, return channels that are provided on the downstream sides of the diffusers to guide the flow of a fluid to the centrifugal impeller in the next stage, and return vanes 7 that are arranged at the respective return channels. Further, a cylindrical rotating flow channel 8 connected to the discharge opening 4 is provided between the outer casing 5 and the inner casing 2, and a connecting channel 9 is provided between the rotating flow channel 8 and the diffusers 6 to connect therebetween. The shape of the meridional plane of the connecting channel 9 is bent or inclined on the side of the suction opening 3 in the rotary shaft direction, and an outflow position in the rotating flow channel 8 is located near a central axis 41*a* of the discharge pipe 41.

With such a shape, a fluid flowing out of a guide impeller blade 11 of the impeller 1 or the diffuser 6 in the last stage flows out near the center of the cross-section of the rotating flow channel 8. Thus, the flow expands in the left and right directions in the rotating flow channel 8 while rotating, and the velocity distribution on the cross-section of the rotating flow channel is balanced and becomes relatively uniform unlike the case where an outlet of the connecting channel is located at an end of the rotating flow channel as in the conventional technique. Thus, occurrence of a fluid loss caused by the imbalance of the velocity distribution can be suppressed. Further, an outlet of the connecting channel 9 is provided near the discharge pipe 41. Thus, a fluid flowing out of the connecting channel 9 near a bottom of the discharge pipe 41 smoothly flows into the discharge opening 4, and the angle of the flow is not largely changed unlike the conventional technique. Accordingly, separation of the flow can be suppressed and a fluid loss that occurs at this position can be also suppressed.

Therefore, this shape solves the above-described first factor of increasing a fluid loss, a pressure loss in the last stage of the multistage pump is decreased, and the efficiency of the pump can be improved. Further, the shape of the connecting channel 9 and the position of the discharge pipe as shown in FIG. 2 are effective in shortening the entire length of the barrel pump. Thus, the pump can be downsized, and cost reduction can be realized by reducing the costs of materials and processes.

(Second Embodiment)

Figure 6A:
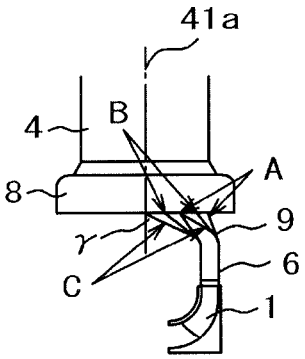
FIG. 6A is a partial cross-sectional view of a second embodiment of the present invention.
Figure 6B:
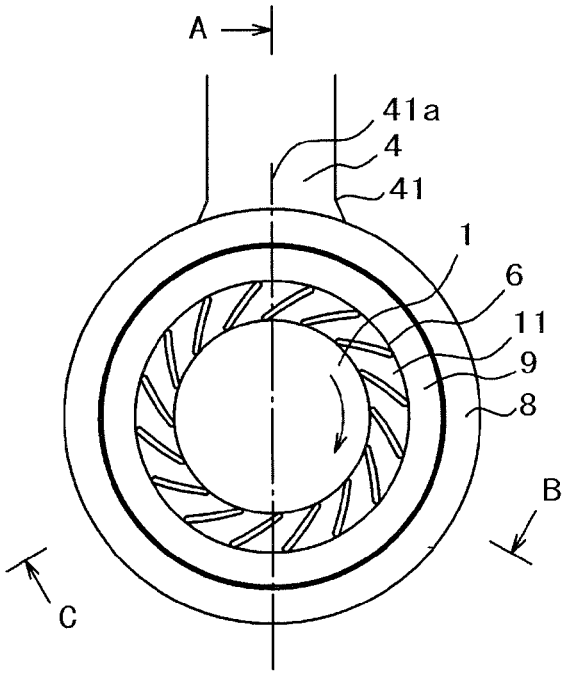
FIG. 6B is an explanation view of the second embodiment of the present invention.

A second embodiment of the present invention is shown in FIG. 6A and FIG. 6B. In the embodiment, the center line and the inclined angles on the meridional plane of the connecting channel 9 that is bent or inclined on the side of the suction opening 3 in the direction of the rotary shaft 10, namely, the inclined angles relative to a center line 41*a* of the discharge pipe 41 are distributed in the circumferential direction of the rotary shaft 10. In FIGS. 6A, A, B, and C show inclinations of angles $\alpha$, $\beta$, and $\gamma$ (a part of which is illustrated) at a position A, a position B, and a position C in FIG. 6B, respectively. The angle ($\alpha$) is small at the position A, and the angle is increased from the position B ($\beta$) to the position C ($\gamma$). With such a configuration, a junction position between the rotating flow channel 8 and the connecting channel 9 is changed in the circumferential direction, a fluid flowing out of the connecting channel 9 is forcibly spread leftward and rightward in the circumferential direction of the rotating flow channel 8, and the velocity distribution on the cross-section of the rotating flow channel 8 can be further uniformed as compared to the first embodiment.

In addition, the outflow position from the connecting channel 9 near the discharge pipe 41 is located near the center line 41*a* of the discharge pipe, a fluid flowing out of the connecting channel 9 can smoothly flow into the discharge pipe 41, and a fluid loss is not increased near this position. Accordingly, the second embodiment solves the above-described first factor of increasing a fluid loss, and the efficiency of the pump can be improved by further reducing the loss. It should be noted that the centrifugal impellers 1 are rotated in the circumferential direction shown by the arrow, and guide blades 11 are provided at the respective diffusers 6.

(Third Embodiment)

Figure 7A:
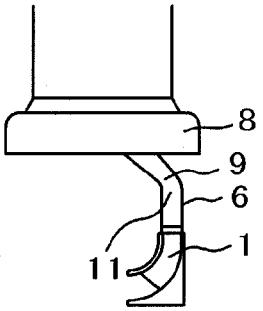
FIG. 7A is a partial cross-sectional view of a third embodiment of the present invention.
Figure 7B:
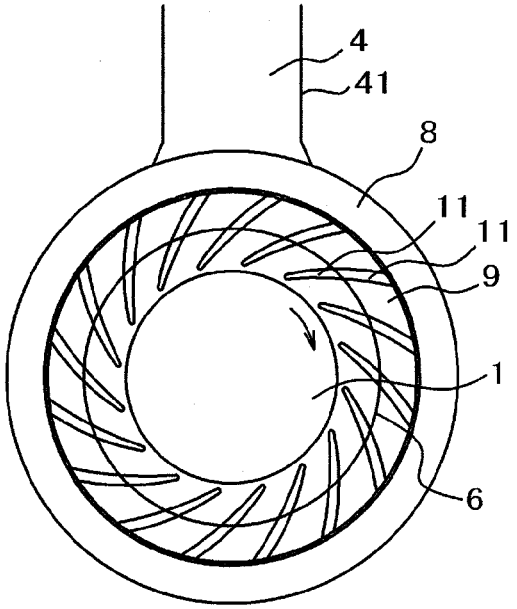
FIG. 7B is an explanation view of the third embodiment of the present invention.

A third embodiment of the present invention is shown in FIG. 7A and FIG. 7B. In the third embodiment, plural guide blades 11 are provided at the connecting channel 9 according to the first embodiment shown in FIG. 2. The guide blades 11 are configured in such a manner that the guide blades 11 provided at the respective diffusers 6 according to the first and second embodiments extend up to the connecting channel 9. With such a configuration, the deceleration rate of a fluid flowing out of the impellers 1 or the guide blades 11 can be further controlled by the guide blades 11 that are arranged so as to extend up to the connecting channel 9, and the flow can be further rectified and uniformed by appropriately allotting the deceleration of the circumferential velocity at the connecting channel 9 and the deceleration at the rotating flow channel 8. Thus, smooth flow without a fluid loss can be realized, and the efficiency of the pump can be improved.

Further, by additionally providing the structures of the guide blades 11, the structural strength at this position can be improved, and reliability of the entire structure of the pump can be improved.

(Fourth Embodiment)

Figure 8A:
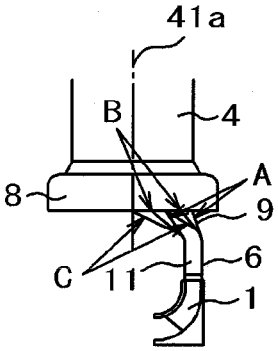
FIG. 8A is a partial cross-sectional view of a fourth embodiment of the present invention.
Figure 8B:
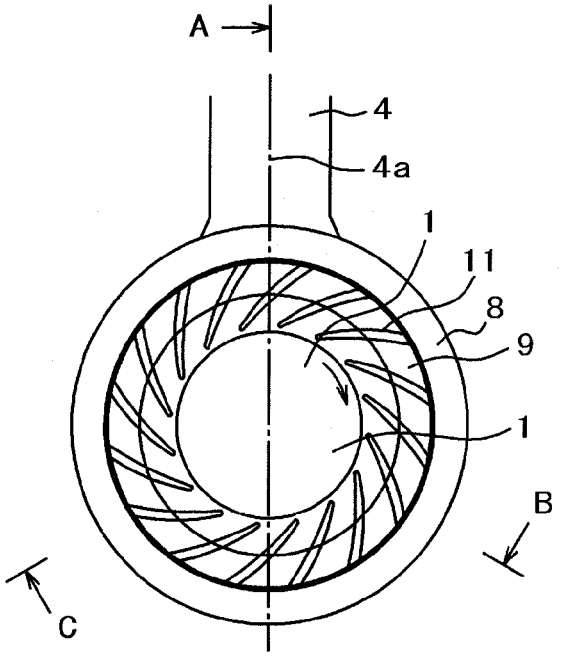
FIG. 8B is an explanation view of the fourth embodiment of the present invention.

A fourth embodiment of the present invention is shown in FIG. 8A and FIG. 8B. The fourth embodiment is the same as the second embodiment in the point that the junction position between the rotating flow channel 8 and the connecting channel 9 is changed in the circumferential direction. Plural guide blades 11 are added to the connecting channel 9 according to the second embodiment shown in FIG. 6A and FIG. 6B, and the guide blades 11 are configured in such a manner that the guide blades 11 provided at the respective diffusers 6 in the second embodiment extend up to the connecting channel 9. With such a configuration, the deceleration rate of a fluid flowing out of the impellers 1 or the guide blades 11 can be further controlled by the guide blades 11 that are arranged at the connecting channel 9, and the flow can be rectified by appropriately allotting the deceleration of the circumferential velocity at the connecting channel 9 and the deceleration at the rotating flow channel 8. Thus, smooth flow without a fluid loss can be realized, and the efficiency of the pump can be improved. Further, by additionally providing the structures of the guide blades 11, the structural strength at this position can be improved, and reliability of the entire structure of the pump can be improved.

(Fifth Embodiment)

Figure 9A:
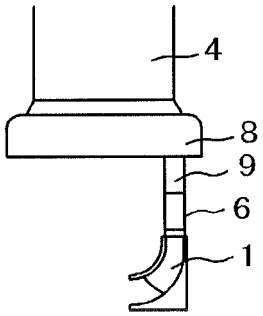
FIG. 9A is a partial cross-sectional view of a fifth embodiment of the present invention.
Figure 9B:
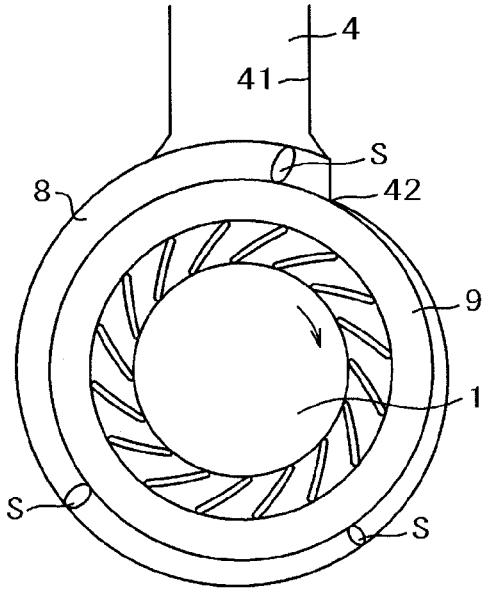
FIG. 9B is an explanation view of the fifth embodiment of the present invention.

A fifth embodiment of the present invention is shown in FIG. 9A and FIG. 9B. In the fifth embodiment, the cylindrical rotating flow channel 8 connected to the discharge opening 4 is provided between the outer casing 5 and the inner casing 2, and the connecting channel 9 is provided between the rotating flow channel 8 and the diffusers 6 to connect therebetween. The radius length of the outer circumference of the rotating flow channel 8 is changed in the circumferential direction, and a cross-sectional area S of the meridional plane of the rotating flow channel 8 is gradually increased from one end of an inner cylinder of the discharge pipe 41 along the rotational direction of the rotary shaft. With such a configuration, a fluid flowing into the rotating flow channel 8 can flow at a substantially constant velocity in one direction and can flow out of the discharge pipe 41.

In the case where the cross-sectional shape of the rotating flow channel 8 is the same in the circumferential direction as in the conventional technique, a fluid flowing out of the connecting channel 9 constantly joins the flow in the rotational direction of the main shaft in the rotating flow channel 8 due to the same cross-sectional area in the circumferential direction. Thus, it can be assumed that the velocity of the flow is increased in the rotational direction of the main shaft, and the fluid finally flows out of the discharge pipe. However, actual flow inside the rotating flow channel 8 is largely different from the assumption. In an upstream area of the rotating flow channel, the cross-sectional area of the meridional plane of the rotating flow channel 8 is large relative to the amount of a fluid that is supposed to flow in the rotational direction of the main shaft. Thus, after a fluid flows into the rotating flow channel in the rotational direction of the impellers, the velocity thereof is largely decreased. Then, the flow is dispersed up to an area apart from a connecting part between the connecting channel and the rotating flow channel. The fluid flows in a direction opposed to the rotational direction of the impellers at an area that is farthest from the connecting part, and flows out of the discharge pipe. The drastic change of the flow direction at the area has caused an increase in a loss in the flow channel.

In the fifth embodiment, since the cross-sectional area of the rotating flow channel 8 is reduced at this position, the fluid smoothly flows. In addition, the entire cross-section of the rotating flow channel is blocked in the swirl direction at one end (protrusion part) 42 of the discharge pipe 41. Thus, no backflow interferes at this position unlike the conventional technique. As a result, the fluid smoothly flows in the rotating flow channel in one direction, and finally flows out of the discharge pipe 41 to an outlet 4. Thus, the efficiency of the pump can be improved without an increase in a fluid loss. Namely, the fifth embodiment shows a structure that solves the above-described second factor of increasing a fluid loss.

(Sixth Embodiment)

Figure 10A:
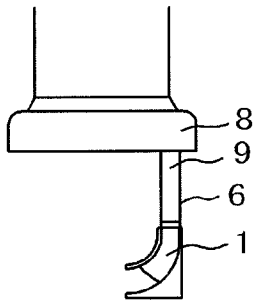
FIG. 10A is a partial cross-sectional view of a sixth embodiment of the present invention.
Figure 10B:
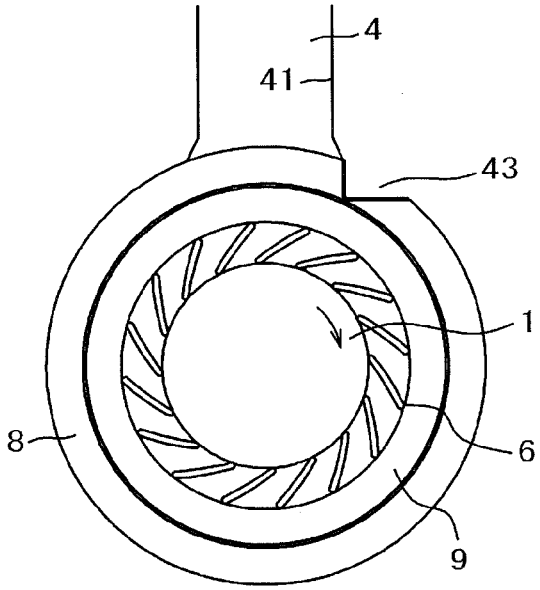
FIG. 10B is an explanation view of the sixth embodiment of the present invention.

A sixth embodiment of the present invention is shown in FIG. 10A and FIG. 10B. In the sixth embodiment, the cylindrical rotating flow channel 8 connected to the discharge opening 4 is provided between the outer casing 5 and the inner casing 2, and the connecting channel 9 is provided between the rotating flow channel 8 and the diffusers 6 to connect therebetween. A protrusion portion 43 protruding towards the inside of the discharge pipe 41 or the rotating flow channel 8 is provided near one end of an inner cylinder of the discharge pipe 41. With such a structure, the entire cross-section of the rotating flow channel is blocked in the swirl direction at one end of the discharge pipe 41 on the downstream side in the swirl direction, as similar to the fifth embodiment. Thus, no backflow interferes at this position unlike the conventional technique. As a result, the fluid smoothly flows in the rotating flow channel in one direction, and finally flows out of the discharge pipe 41 to the outlet 4. Thus, the efficiency of the pump can be improved without an increase in a fluid loss. Namely, the fifth embodiment shows a structure that solves the above-described second factor of increasing a fluid loss as described above.

With such a structure, for example, the protrusion portion 43 may be produced and mounted as a part that is different from the outer casing 5, and the rotating flow channel 8 provided at the outer casing 5 may be produced while the cross-section thereof is made constant in the circumferential direction. Accordingly, the shape of the rotating flow channel can be easily formed, leading to improvement in reliability of production and reduction in production cost.

(Seventh Embodiment)

Figure 11A:
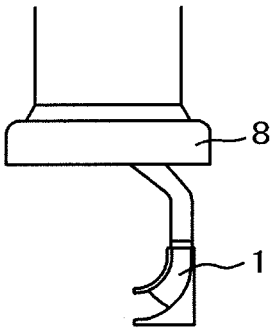
FIG. 11A is a partial cross-sectional view of a seventh embodiment of the present invention.
Figure 11B:
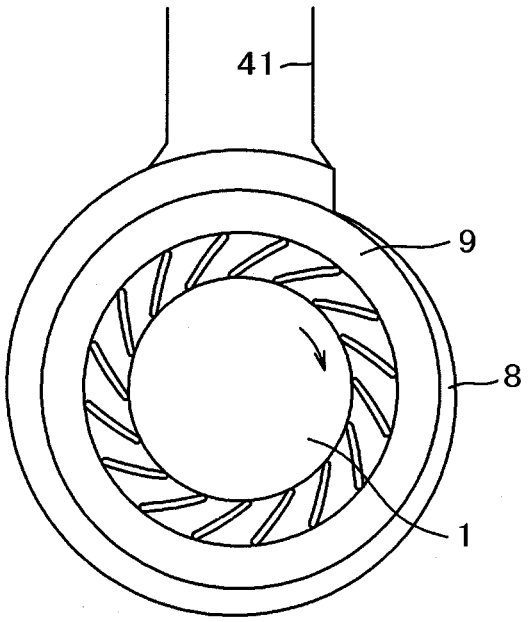
FIG. 11B is an explanation view of the seventh embodiment of the present invention.

A seventh embodiment of the present invention is shown in FIG. 11A and FIG. 11B. In the seventh embodiment, the cross-sectional area of the meridional plane of the rotating flow channel 8 is gradually increased from one end of the inner cylinder of the discharge pipe 41 along the rotational direction of the rotary shaft in the first embodiment shown in FIG. 2. Two elements of: the shape of the meridional plane of the connecting channel 9 is bent or inclined, and the outflow position in the rotating flow channel 8 is located near the central axis of the discharge pipe; and the radius length of the outer circumference of the rotating flow channel 8 is changed in the circumferential direction, and the cross-sectional area of the meridional plane of the rotating flow channel 8 is gradually increased from one end of the inner cylinder of the discharge pipe 41 along the rotational direction of the rotary shaft are combined. Accordingly, the above-described first and second factors of increasing a fluid loss can be simultaneously suppressed, and thus the performance in the last stage of the multistage pump can be significantly improved.

(Eighth Embodiment)

Figure 12A:
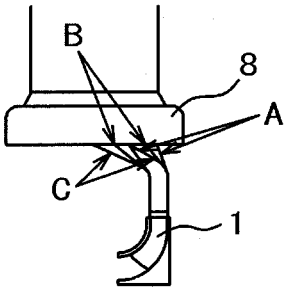
FIG. 12A is a partial cross-sectional view of an eighth embodiment of the present invention.
Figure 12B:
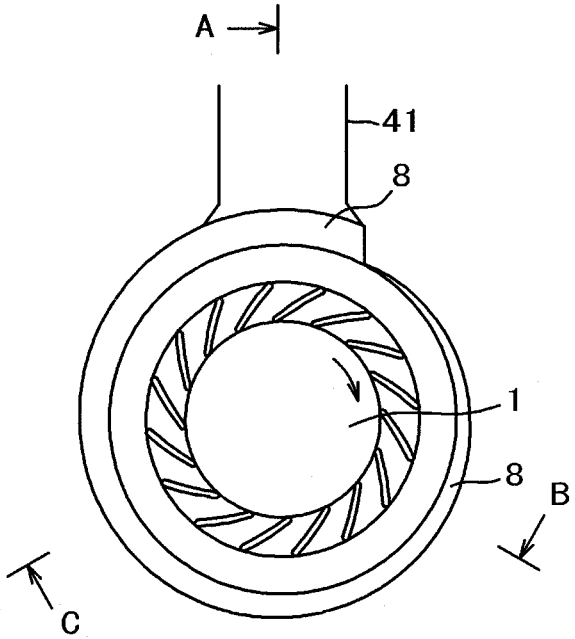
FIG. 12B is an explanation view of the eighth embodiment of the present invention.

An eighth embodiment of the present invention is shown in FIG. 12A and FIG. 12B. In the eighth embodiment, the cross-sectional area of the meridional plane of the rotating flow channel 8 is gradually increased from one end of the inner cylinder of the discharge pipe 41 along the rotational direction of the rotary shaft in the second embodiment shown in FIG. 6A and FIG. 6B. Two elements of: the inclined angles of the center line on the meridional plane of the connecting channel at the inclined part of the connecting channel 9 are distributed relative to the center line of the discharge pipe 41 in the circumferential direction; and the radius length of the outer circumference of the rotating flow channel 8 is changed in the circumferential direction, and the cross-sectional area of the meridional plane of the rotating flow channel is gradually increased from one end of the inner cylinder of the discharge pipe along the rotational direction of the rotary shaft are combined. Accordingly, the above-described first and second factors of increasing a fluid loss can be suppressed at once, and thus the performance in the last stage of the multistage pump can be significantly improved.

(Ninth Embodiment)

Figure 13A:
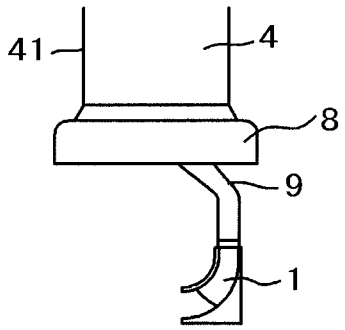
FIG. 13A is a partial cross-sectional view of a ninth embodiment of the present invention.
Figure 13B:
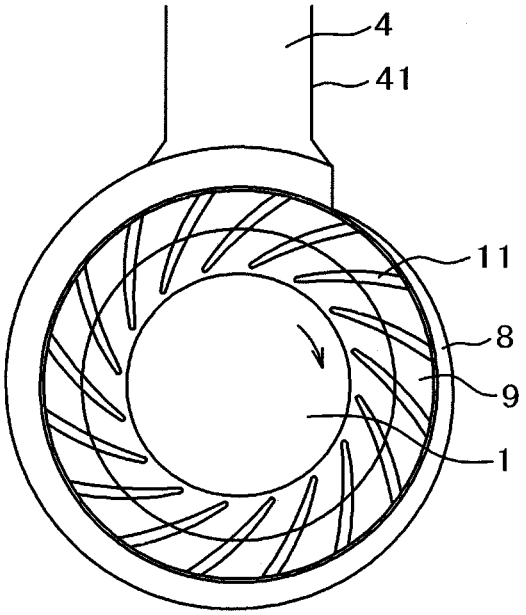
FIG. 13B is an explanation view of the ninth embodiment of the present invention.

A ninth embodiment of the present invention is shown in FIG. 13A and FIG. 13B. In the ninth embodiment, the cross-sectional area of the meridional plane of the rotating flow channel 8 is gradually increased from one end of the inner cylinder of the discharge pipe 41 along the rotational direction of the rotary shaft in the third embodiment shown in FIG. 7A and FIG. 7B. Three elements of: the shape of the meridional plane of the connecting channel 9 is bent or inclined, and the outflow position in the rotating flow channel 8 is located near the central axis of the discharge pipe 41; the plural guide blades 11 are provided at the connecting channel 9; and the radius length of the outer circumference of the rotating flow channel 8 is changed in the circumferential direction, and the cross-sectional area of the meridional plane of the rotating flow channel 8 is gradually increased from one end of the inner cylinder of the discharge pipe 41 along the rotational direction of the rotary shaft are combined. Accordingly, the above-described first and second factors of increasing a fluid loss can be simultaneously suppressed, and thus the performance in the last stage of the multistage pump can be significantly improved.

(Tenth Embodiment)

Figure 14A:
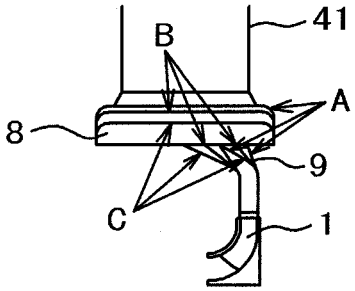
FIG. 14A is a partial cross-sectional view of a tenth embodiment of the present invention.
Figure 14B:
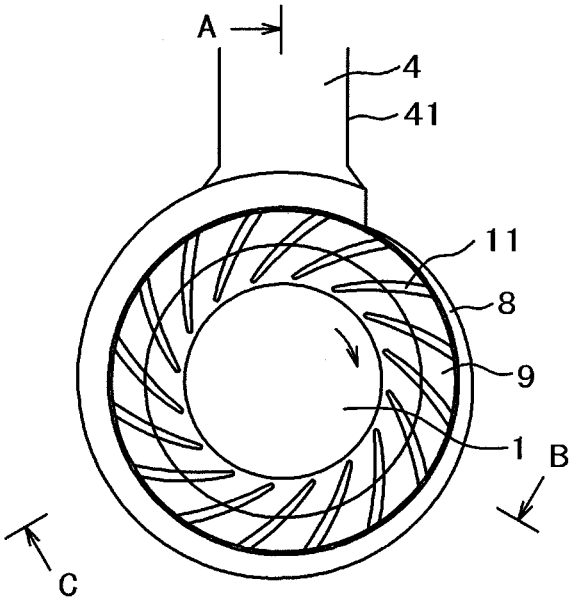
FIG. 14B is an explanation view of the tenth embodiment of the present invention.

A tenth embodiment of the present invention is shown in FIG. 14A and FIG. 14B. In the tenth embodiment, the cross-sectional area of the meridional plane of the rotating flow channel 8 is gradually increased from one end of the inner cylinder of the discharge pipe 41 along the rotational direction of the rotary shaft in the fourth embodiment shown in FIG. 8A and FIG. 7B. Three elements of: the inclined angles of the center line on the meridional plane of the connecting channel at the inclined part of the connecting channel 9 are distributed relative to the center line of the discharge pipe 41 in the circumferential direction; the plural guide blades 11 are provided at the connecting channel 9; and the radius length of the outer circumference of the rotating flow channel 8 is changed in the circumferential direction, and the cross-sectional area of the meridional plane of the rotating flow channel 8 is gradually increased from one end of the inner cylinder of the discharge pipe 41 along the rotational direction of the rotary shaft are combined. Accordingly, the above-described first and second factors of increasing a fluid loss can be simultaneously suppressed, and thus the performance in the last stage of the multistage pump can be significantly improved.

(Eleventh Embodiment)

Figure 15A:
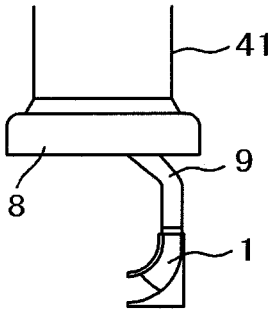
FIG. 15A is a partial cross-sectional view of an eleventh embodiment of the present invention.
Figure 15B:
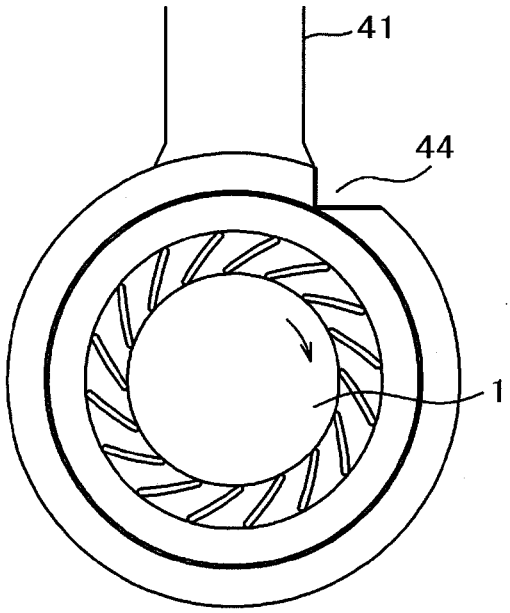
FIG. 15B is an explanation view of the eleventh embodiment of the present invention.

An eleventh embodiment of the present invention is shown in FIG. 15A and FIG. 15B. In the eleventh embodiment, a protrusion portion 44 protruding towards the inside of the discharge pipe 41 or the rotating flow channel 8 is provided near one end of the inner cylinder of the discharge pipe 41 in the first embodiment shown in FIG. 2. Two elements of: the shape of the meridional plane of the connecting channel 9 is bent or inclined, and the outflow position in the rotating flow channel 8 is located near the central axis of the discharge pipe 41; and the protrusion portion 44 is provided near one end of the inner cylinder of the discharge pipe 41 are combined. Accordingly, the above-described first and second factors of increasing a fluid loss can be simultaneously suppressed, and thus the performance in the last stage of the multistage pump can be significantly improved.

(Twelfth Embodiment)

Figure 16A:
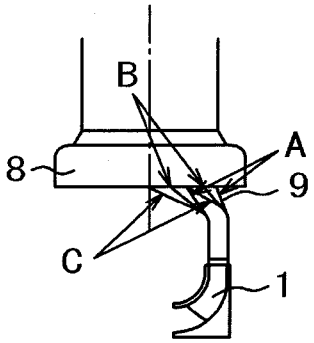
FIG. 16A is a partial cross-sectional view of a twelfth embodiment of the present invention.
Figure 16B:
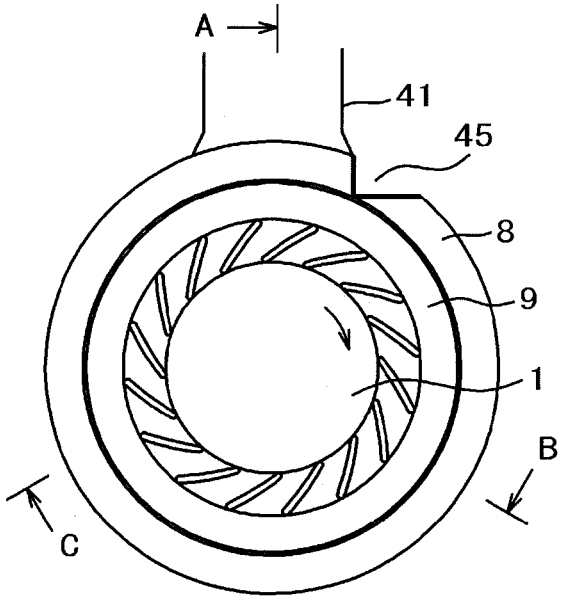
FIG. 16B is an explanation view of the twelfth embodiment of the present invention.

A twelfth embodiment of the present invention is shown in FIG. 16A and FIG. 16B. In the twelfth embodiment, a protrusion portion 45 protruding towards the inside of the discharge pipe 41 or the rotating flow channel 8 is provided near one end of the inner cylinder of the discharge pipe 41 in the second embodiment shown in FIG. 6A and FIG. 6B. Two elements of: the inclined angles of the center line on the meridional plane of the connecting channel at the inclined part of the connecting channel 9 are distributed relative to the centerline of the discharge pipe 41 in the circumferential direction; and the protrusion portion 45 is provided near one end of the inner cylinder of the discharge pipe 41 are combined. Accordingly, the above-described first and second factors of increasing a fluid loss can be suppressed at once, and thus the performance in the last stage of the multistage pump can be significantly improved.

(Thirteenth Embodiment)

Figure 17A:
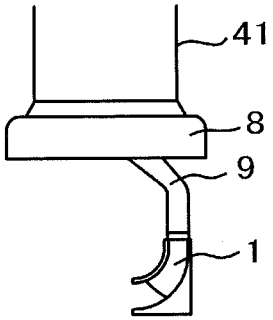
FIG. 17A is a partial cross-sectional view of a thirteenth embodiment of the present invention.
Figure 17B:
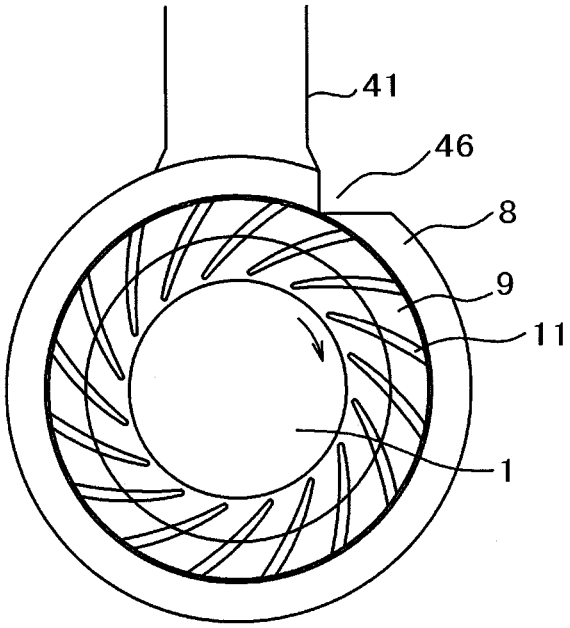
FIG. 17B is an explanation view of the thirteenth embodiment of the present invention.

A thirteenth embodiment of the present invention is shown in FIG. 17A and FIG. 17B. In the thirteenth embodiment, a protrusion portion 46 protruding towards the inside of the discharge pipe 41 or the rotating flow channel 8 is provided near one end of the inner cylinder of the discharge pipe 41 in the third embodiment shown in FIG. 7A and FIG. 7B. Three elements of: the shape of the meridional plane of the connecting channel 9 is bent or inclined on the suction opening side in the rotary shaft direction, and the outflow position in the rotating flow channel 8 is located near the central axis of the discharge pipe 41; the plural guide blades 11 are provided at the connecting channel; and the protrusion portion 46 is provided near one end of the inner cylinder of the discharge pipe 41 are combined. Accordingly, the above-described first and second factors of increasing a fluid loss can be suppressed at once, and thus the performance in the last stage of the multistage pump can be significantly improved.

(Fourteenth Embodiment)

Figure 18A:
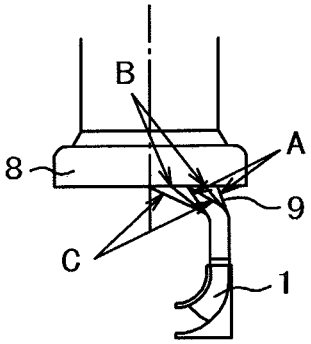
FIG. 18A is a partial cross-sectional view of a fourteenth embodiment of the present invention.
Figure 18B:
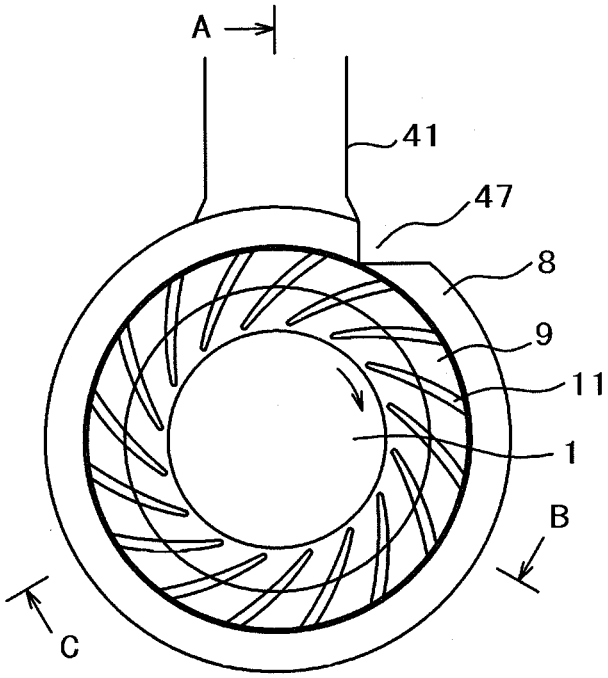
FIG. 18B is an explanation view of the fourteenth embodiment of the present invention.

A fourteenth embodiment of the present invention is shown in FIG. 18A and FIG. 18B. In the fourteenth embodiment, a protrusion portion 47 protruding towards the inside of the discharge pipe 41 or the rotating flow channel 8 is provided near one end of the inner cylinder of the discharge pipe 41 in the fourth embodiment shown in FIG. 8A and FIG. 8B. Three elements of: the inclined angles of the center line on the meridional plane of the connecting channel at the inclined part of the connecting channel 9 are distributed relative to the center line of the discharge pipe 41 in the circumferential direction; the plural guide blades 11 are provided at the connecting channel 9; and the protrusion portion 47 is provided near one end of the inner cylinder of the discharge pipe 41 are combined. Accordingly, the above-described first and second factors of increasing a fluid loss can be suppressed at once, and thus the performance in the last stage of the multistage pump can be significantly improved.

What is claimed is:

1. A barrel-type multistage pump comprising:

centrifugal impellers that are provided at a rotary shaft in plural stages;

an inner casing that covers the centrifugal impellers, and includes diffusers that are provided on the downstream sides of the respective centrifugal impellers in plural stages, return channels that are provided on the downstream sides of the diffusers to guide the flow of a fluid to the centrifugal impeller in the next stage, and return vanes that are arranged at the respective return channels; and a cylindrical outer casing that has a suction pipe as the inlet and a discharge pipe as the outlet of the fluid, wherein a cylindrical rotating flow channel connected to a discharge opening is provided between the outer casing and the inner casing, a connecting channel is provided between the rotating flow channel and a last stage diffuser of the diffusers to connect therebetween, the shape on a meridional plane of the connecting channel is inclined on a suction opening side in the rotary shaft direction, and an outflow position of the connecting channel in the rotating flow channel is located near the central axis of the discharge pipe, and a plurality of guide blades are provided in the connecting channel.

2. The barrel-type multistage pump according to claim 1, wherein a protrusion portion provided near one end of an inner cylinder of the discharge pipe and which protrudes towards the inside of the discharge pipe or the rotating flow channel.

3. The barrel-type multistage pump according to claim 2, wherein the radius length of the outer circumference of the rotating flow channel is changed in the circumferential direction, and the cross-sectional area of the rotating flow channel is gradually increased from the one end of the inner cylinder of the discharge pipe along the rotational direction of the rotary shaft.

4. A barrel-type multistage pump comprising:

centrifugal impellers that are provided at a rotary shaft in plural stages;

an inner casing that covers the centrifugal impellers, and includes diffusers that are provided on the downstream sides of the respective centrifugal impellers in plural stages, return channels that are provided on the downstream sides of the diffusers to guide the flow of a fluid to the centrifugal impeller in the next stage, and return vanes that are arranged at the respective return channels; and a cylindrical outer casing that has a suction pipe as the inlet and a discharge pipe as the outlet of the fluid, wherein a cylindrical rotating flow channel connected to a discharge opening is provided between the outer casing and the inner casing, a connecting channel is provided between the rotating flow channel and a last stage diffuser of the diffusers to connect therebetween, the shape on a meridional plane of the connecting channel is inclined on a suction opening side in the rotary shaft direction, and an outflow position of the connecting channel in the rotating flow channel is located near the central axis of the discharge pipe, and inclined angles of a center line on the meridional plane of the connecting channel relative to a center line of the discharge pipe are distributed in the circumferential direction of the rotary shaft.

5. The barrel-type multistage pump according to claim 4, wherein a plurality of guide blades are provided in the connecting channel.

6. The barrel-type multistage pump according to claim 5, wherein a protrusion portion protruding towards the inside of the discharge pipe or the rotating flow channel is provided near one end of an inner cylinder of the discharge pipe.

7. The barrel-type multistage pump according to claim 6, wherein the radius length of the outer circumference of the rotating flow channel is changed in the circumferential direction, and the cross-sectional area of the rotating flow channel is gradually increased from the one end of the inner cylinder of the discharge pipe along the rotational direction of the rotary shaft.

8. A barrel-type multistage pump comprising:

centrifugal impellers provided along a rotary shaft in plural stages;

an inner casing covering the centrifugal impellers, the inner casing including diffusers provided on downstream sides of the centrifugal impellers, return channels provided on downstream sides of the diffusers, and return vanes provided in the return channels;

a cylindrical outer casing including a suction pipe as an inlet of a fluid and a discharge pipe as an outlet of the fluid;

a cylindrical rotating flow channel connected to a discharge opening of the discharge pipe, the rotating flow channel being provided between the outer casing and the inner casing; and a connecting channel provided between the rotating flow channel and a last stage diffuser of the diffusers, the connecting channel being inclined to a suction opening side in the rotary shaft direction, and an outflow position of the connecting channel being configured to direct the fluid toward a central axis of the discharge pipe, wherein a plurality of guide blades are provided in the connecting channel.

9. The barrel-type multistage pump according to claim 8, wherein a protrusion portion protruding towards the inside of the discharge pipe or the rotating flow channel is provided near one end of an inner cylinder of the discharge pipe.

10. The barrel-type multistage pump according to claim 9, wherein the radius length of the outer circumference of the rotating flow channel is changed in the circumferential direction, and the cross-sectional area of the rotating flow channel is gradually increased from the one end of the inner cylinder of the discharge pipe along the rotational direction of the rotary shaft.

* * * * *